US012492702B2

(12) United States Patent
Lin

(10) Patent No.: US 12,492,702 B2
(45) Date of Patent: Dec. 9, 2025

(54) HIGH-SPEED NECK FAN

(71) Applicant: Shenzhen Hengmeite Technology Co., Ltd, Shenzhen (CN)

(72) Inventor: Yongcai Lin, Huilai (CN)

(73) Assignee: Shenzhen Hengmeite Technology Co., Ltd, Shenzhen (CN)

( * ) Notice: Subject to any disclaimer, the term of this patent is extended or adjusted under 35 U.S.C. 154(b) by 0 days.

(21) Appl. No.: 18/826,590

(22) Filed: Sep. 6, 2024

(65) Prior Publication Data

US 2024/0426308 A1 Dec. 26, 2024

(30) Foreign Application Priority Data

Jul. 26, 2024 (CN) ..... 202421788290.6

(51) Int. Cl.
*F04D 25/08* (2006.01)
*F04D 25/06* (2006.01)
*F04D 29/52* (2006.01)

(52) U.S. Cl.
CPC ..... *F04D 25/08* (2013.01); *F04D 25/0673* (2013.01); *F04D 29/522* (2013.01)

(58) Field of Classification Search
CPC .... F04D 25/0673; F04D 25/08; F04D 25/088; F04D 29/522
See application file for complete search history.

(56) References Cited

U.S. PATENT DOCUMENTS

| | | | | |
|---|---|---|---|---|
| 10,578,119 | B2 * | 3/2020 | Lee | A41D 20/005 |
| 11,873,825 | B2 * | 1/2024 | Liu | F04D 29/4226 |
| 12,281,656 | B1 * | 4/2025 | Zhu | F04D 25/084 |
| 2021/0324865 | A1 * | 10/2021 | Park | F04D 25/084 |
| 2022/0145896 | A1 | 5/2022 | Li | |
| 2023/0272802 | A1 | 8/2023 | Li | |
| 2024/0102488 | A1 * | 3/2024 | Xie | F04D 29/4246 |
| 2024/0229809 | A1 † | 7/2024 | Zheng | |
| 2024/0309879 | A1 * | 9/2024 | Xie | F04D 29/4213 |

FOREIGN PATENT DOCUMENTS

| | | | |
|---|---|---|---|
| CN | 113236590 A | † | 8/2021 |
| CN | 217029363 U | † | 7/2022 |
| CN | 217107518 U | † | 8/2022 |

* cited by examiner
† cited by third party

*Primary Examiner* — Jesse S Bogue
(74) *Attorney, Agent, or Firm* — Zhigang Ma

(57) ABSTRACT

The present disclosure discloses a high-speed neck fan, including a hanging piece and a fan body connected to an end portion of the hanging piece; the fan body includes a shell; an air duct and a coordination base are formed on the shell; the coordination base is connected to one side of a periphery of the air duct; the air duct and the coordination base are in a stacked state on a radial cross section of the air duct; one end of the air duct is an air inlet, and the other end is an air outlet. According to the present disclosure, when a user wears the high-speed neck fan, the high-speed neck fan is stable and will hardly move or fall off. Furthermore, the air speed and the air supply distance are greatly improved. The user experience is effectively enhanced.

10 Claims, 7 Drawing Sheets

HIGH-SPEED NECK FAN

TECHNICAL FIELD

The present disclosure relates to the technical field of fans, and in particular, to a high-speed neck fan.

BACKGROUND

When people go out or engage in outdoor activities in the hot summer, there may be no air conditioner. To facilitate enjoying the cool at any time, portable fans have emerged, which enjoy great popularity because they are convenient to carry and can be used at any time.

Neck fans are most suitable for being carried and used during outdoor activities. The neck fans can be worn on the neck of a person and can be used without being held in a hand of the user, thereby achieving the effect of freeing up the hands.

There are roughly two types of neck fans nowadays. One type of neck fan is as follows: A fan is integrated into a semi-enclosed annular hanging body. An air outlet, an air inlet, and various related electric devices are mounted on the hanging body. In a working process of this neck fan, a moving device is closer to the neck of a user. Therefore, there will be obvious working noise during use. Although this neck fan can achieve a corresponding air blowing cooling effect, the user has to endure the noise, so that the use experience is not ideal. Moreover, the various related electric devices are arranged along the hanging body, the gravity center is not uniform. When this neck fan is worn and used, the neck fan easily deviates or is easily separated from the neck of the user because of unstable wearing. The other type of neck fan is as follows: Two ends of a snake-shaped hose are respectively connected to two fan bodies. The snake-shaped hose can be worn at the neck of a user after deformation, and air blowing directions of the fan bodies at the two ends can also be adjusted by changing the shape of the snake-shaped hose. However, at present, during use of this type of fan, the fan bodies are relatively light in weight and generate low downward pulling force at the two ends of the snake-shaped hose. Therefore, unstable wearing easily occurs too in the wearing process. Especially when the directions of the fan bodies are adjusted, the gravity centers of the fan bodies will shift significantly. Therefore, there is a serious mutual constraint between the wearing stability and the adjustment of the air blowing directions. As a result, the use experience is not ideal.

In addition, due to the structural limitation, the existing neck fan cannot achieve a high-speed air blowing effect, and the cooling effect is insufficient to an extent.

SUMMARY

The present disclosure aims to provide a high-speed neck fan. When a user wears the high-speed neck fan, the high-speed neck fan is stable and will hardly move or fall off. Furthermore, the air speed and the air supply distance are greatly improved, and a silencing and denoising effect is achieved too. The user experience is effectively enhanced, and the problems mentioned in the above background section are solved.

To achieve the above objective, the present disclosure provides the following technical solution: A high-speed neck fan includes a hanging piece and a fan body connected to an end portion of the hanging piece; the fan body includes a shell; an air duct and a coordination base are formed on the shell; the coordination base is connected to one side of a periphery of the air duct; the air duct and the coordination base are in a stacked state on a radial cross section of the air duct; one end of the air duct is an air inlet, and the other end is an air outlet; an air-driving fan blade group is arranged in the air duct; and the air-driving fan blade group guides an air flow located at the air inlet to pass through the air duct and then be blown out from the air outlet in an accelerated manner.

Preferably, a motor base is coaxially arranged in the air duct; a portion of a circumferential wall surface of the motor base extends towards an inner wall of the air duct to form booster blades; the booster blades are arranged on one side of the air-driving fan blade group facing the air outlet; the air-driving fan blade group includes a rotating seat and air-driving blades uniformly arranged on a peripheral wall surface of the rotating seat; rectifier blades are arranged on sides of the booster blades away from the air-driving fan blade group; the booster blades achieves air-cutting boosting on an air flow conveyed by the air-driving blades; and the rectifier blades guide the boosted air flow output from the booster blades, so that the boosted air flow is blown outwards in a direction parallel to an axial direction of the air outlet.

Preferably, a surface of each of the booster blades facing an outer side of the air outlet is a windward surface, and a surface of one side of each of the air-driving blades facing the booster blade is an air-driving surface; in a rotation process of the air-driving fan blade group, the air-driving surfaces rotate towards the windward surfaces; in the same radial area, a curved surface where the windward surface is located is intersected with a curved surface where the air-driving surface is located; and an angle between the windward surface and the air-driving surface is $\theta 1<90°$.

Preferably, an angle $\theta 2$ between the windward surface and a central axis of the air-driving fan blade group satisfies: $30°<\theta 2<60°$.

Preferably, the angle between the windward surface and the central axis of the air-driving fan blade group is $\theta 2=45°$.

Preferably, an air guide member is sleeved in the air duct; the air guide member is a tubular body; the motor base is arranged in the air guide member; the booster blades are formed by extension of the portion of the circumferential wall surface of the motor base towards an inner wall of the air guide member; a linear slot is provided on an outer wall surface of the air guide member; the linear slot extends in an axial direction of the air guide member; a linear column corresponding to the linear slot is arranged on an inner wall surface of the air duct; and the air guide member cooperates with the linear column through the linear slot to achieve directed sliding.

Preferably, an outlet housing is covered at the air outlet; a connecting base is coaxially arranged at a central axis of the outlet housing; the rectifier blades are formed by radial extension of a portion of a circumferential wall surface of the connecting base; the rectifier blades are arranged in a manner of being parallel to a central axis of the air outlet; a limiting step is arranged at the air outlet on an inner wall surface of the air duct; a limiting flange corresponding to the limiting step is arranged on an outer wall of the outlet housing; the outlet housing is integrally connected to the air duct through opposite limitation by the limiting step and the limiting flange.

Preferably, an end portion of the hanging piece is fixedly connected to the fan body through a connecting mechanism; the connecting mechanism includes a hole groove provided on the fan body, a plug plugged into the hole groove, a ring slot arranged at an end portion of the hanging piece, and a clamping ring clamped with the ring slot; the hole groove penetrates through the shell of the fan body; the plug is provided with an axial through hole; the end portion of the hanging piece passes through the hole groove and the through hole of the plug in sequence, and is in buckling connection to the clamping ring; a stud is arranged in the hole groove; the stud is parallel to a central axis of the hole groove; the plug is provided with a stud sleeve corresponding to the stud; and the stud sleeve sleeves the stud in a circumferential direction.

Preferably, an inlet housing is covered at the air inlet.

Preferably, each of two end portions of the hanging piece is respectively connected with the fan body; a circuit board assembly is arranged in the coordination base of one fan body; the air-driving fan blade group in the air duct of the fan body is electrically connected to the circuit board assembly; a storage battery is arranged in the coordination base of the other fan body; and the storage battery and the air-driving fan blade group in the same fan body as the storage battery are electrically connected to the circuit board assembly through an internal routing of the hanging piece.

Preferably, the circuit board assembly is electrically connected with a control button, a USB interface, and a light-emitting bead; the control button, the USB interface, and the light-emitting bead are all arranged in preset through holes of the shell of the coordination base; and a thermal insulation pad is sandwiched between the storage battery and a wall surface of one side of the coordination base away from the air duct.

Preferably, the hanging piece is a deformable snake-shaped pipe.

Compared with the prior art, the present disclosure has the beneficial effects below:

According to the present disclosure, the coordination base is formed on a side surface of the air duct. The coordination base deviates from the axis of the air duct. When the fan is worn at the neck of a user, the coordination base is sandwiched between the user and the air duct, and can support the fan bodies, so that the air outlets of the fan can be appropriately far away from a blocked area of the user and can also blow air towards the head of the user. This not only ensures a smoother air outlet path and a better air blowing and cooling effect, but also improves the stability of wearing of the fan by forming friction between an outer wall of the coordination base and the user. In addition, the downward pulling force of the fan bodies can be increased by performing weight balancing on electric devices inside the coordination base, which further improves the stability of wearing of the fan. By the arrangement of a booster and rectifier mechanism on the air duct, the air speed and the air supply distance are greatly increased, and a silencing and denoising effect is achieved too. The user experience is effectively enhanced.

Figure 1:
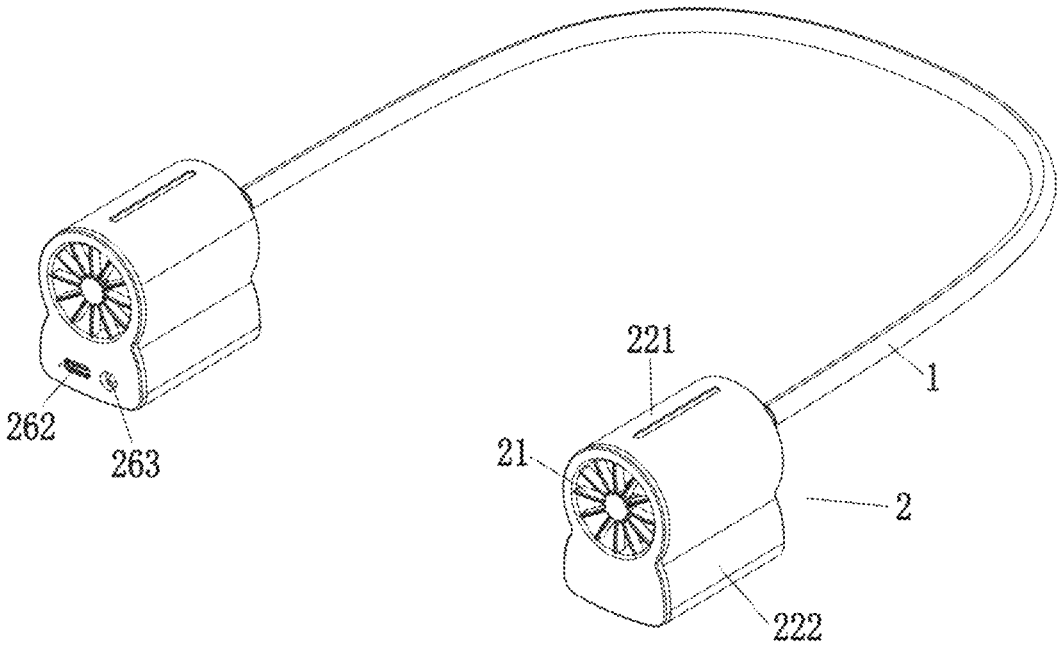
FIG. 1 is a schematic structural diagram of the present disclosure.

In the drawings: 1: hanging member; 11: ring slot; 12: clamping ring; 13: plug; 131: stud sleeve; 2: fan body; 21: inlet housing; 22: shell; 221: air duct; 222: coordination base; 223: air inlet; 224: air outlet; 225: limiting step; 226: linear column; 23: air-driving fan blade group; 231: rotating seat; 232: air-driving blade; 233: air-driving surface; 24: air guide member; 241: motor base; 242: booster blade; 243: windward surface; 244: linear slot; 25: outlet housing; 251: connecting base; 252: hole groove; 253: stud; 254: rectifier blade; 255: limiting flange; 26: circuit board assembly; 261: control button; 262: USB interface; 263: light-emitting bead; 27: storage battery; and 28: thermal insulation pad.

DETAILED DESCRIPTION OF THE EMBODIMENTS

The technical solutions in the embodiments of the present disclosure are clearly and completely described below with reference to the accompanying drawings in the embodiments of the present disclosure. Apparently, the described embodiments are merely some embodiments of the present disclosure, rather than all of the embodiments. All other embodiments obtained by a person of ordinary skill in the art based on the embodiments of the present disclosure without making creative efforts shall fall within the protection scope of the present disclosure.

Figure 2:
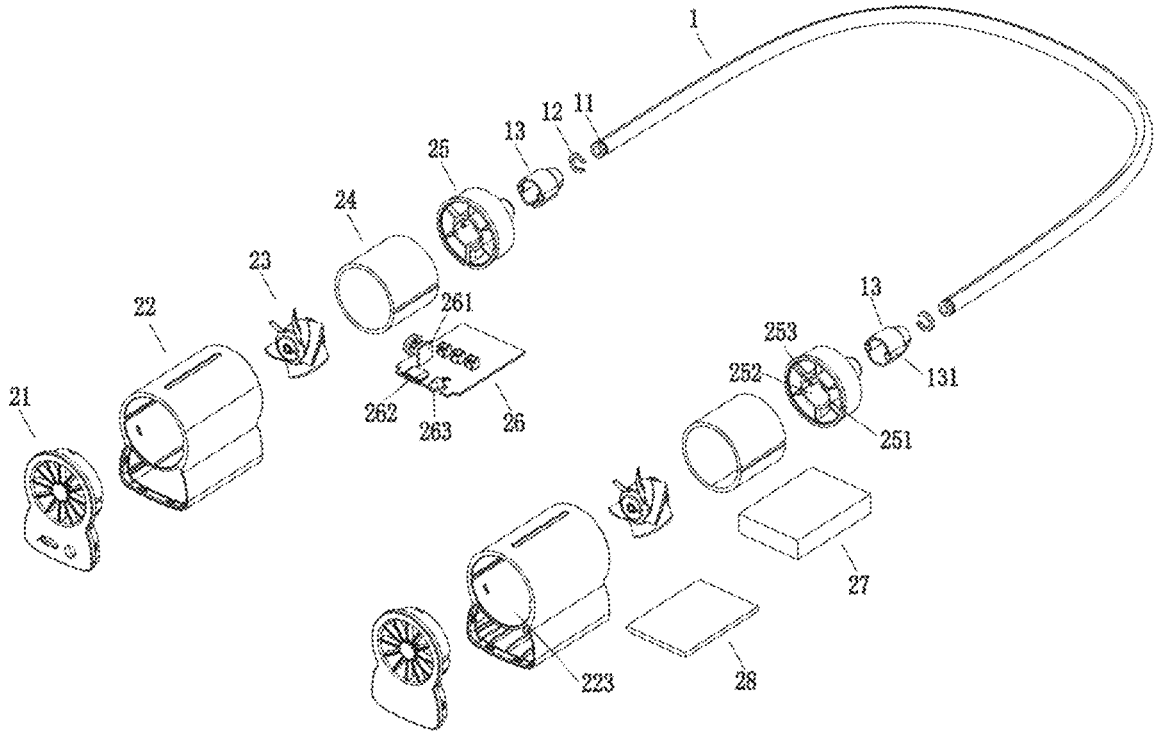
FIG. 2 is a structural exploded diagram I of the present disclosure.
Figure 3:
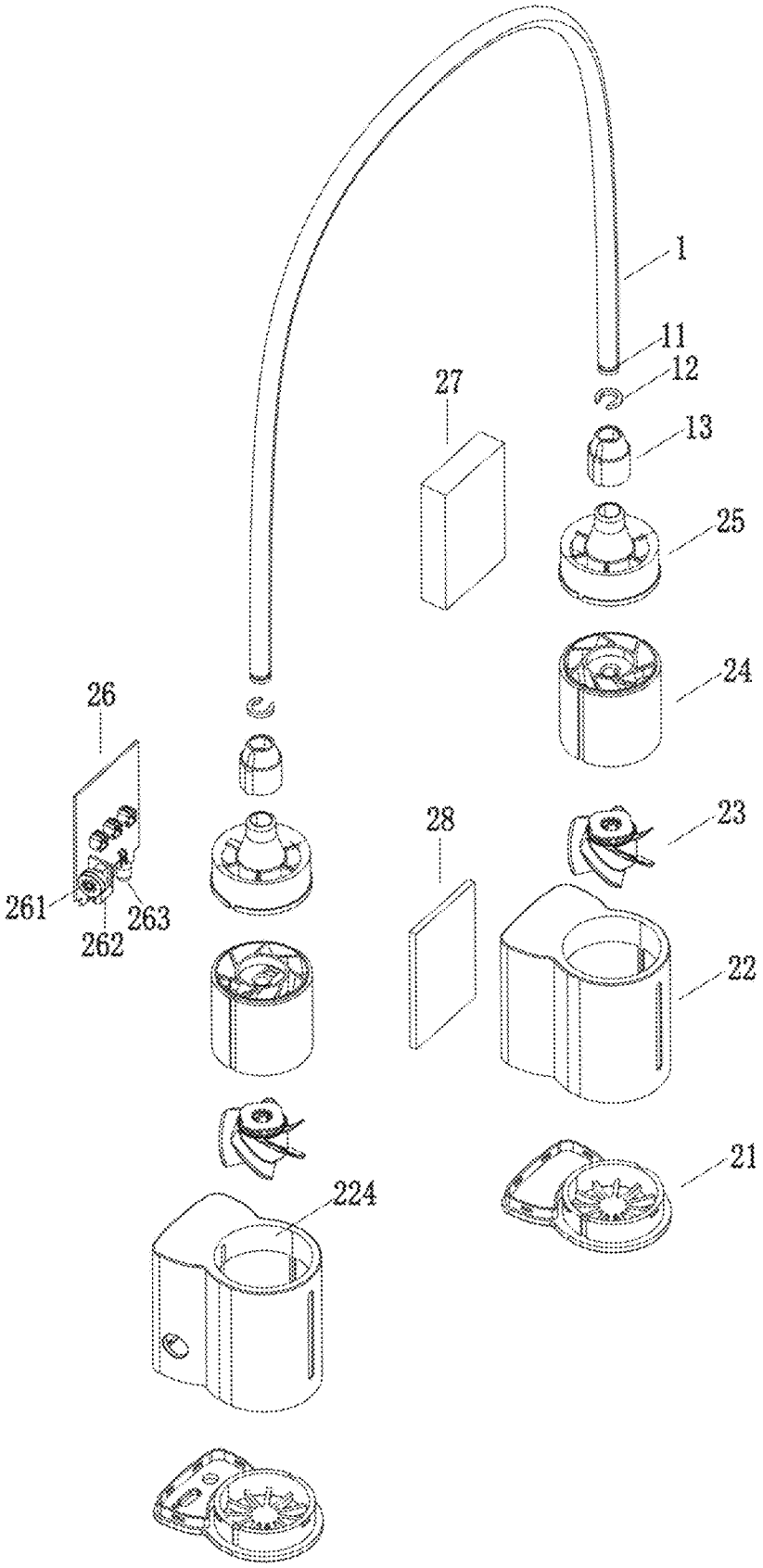
FIG. 3 is a structural exploded diagram II of the present disclosure.
Figure 4:
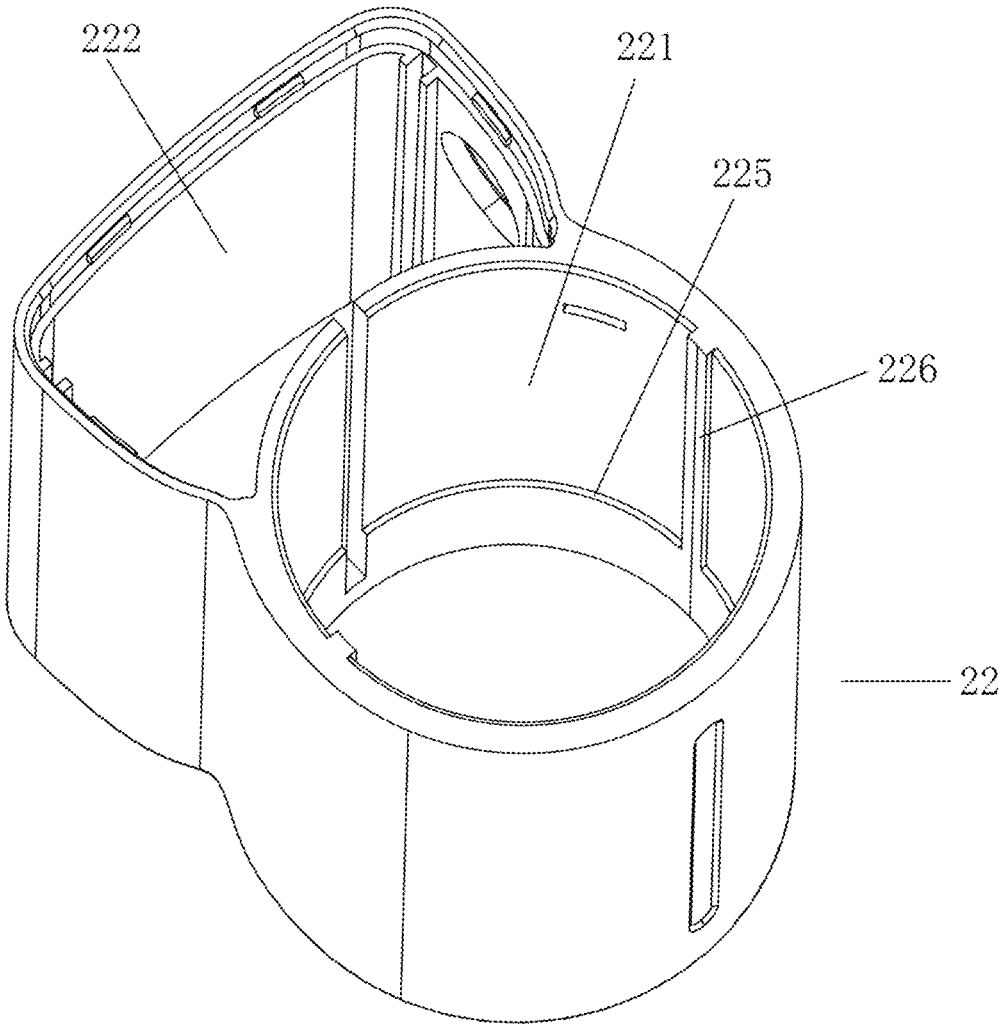
FIG. 4 is a schematic structural diagram of a shell of the present disclosure.
Figure 5:
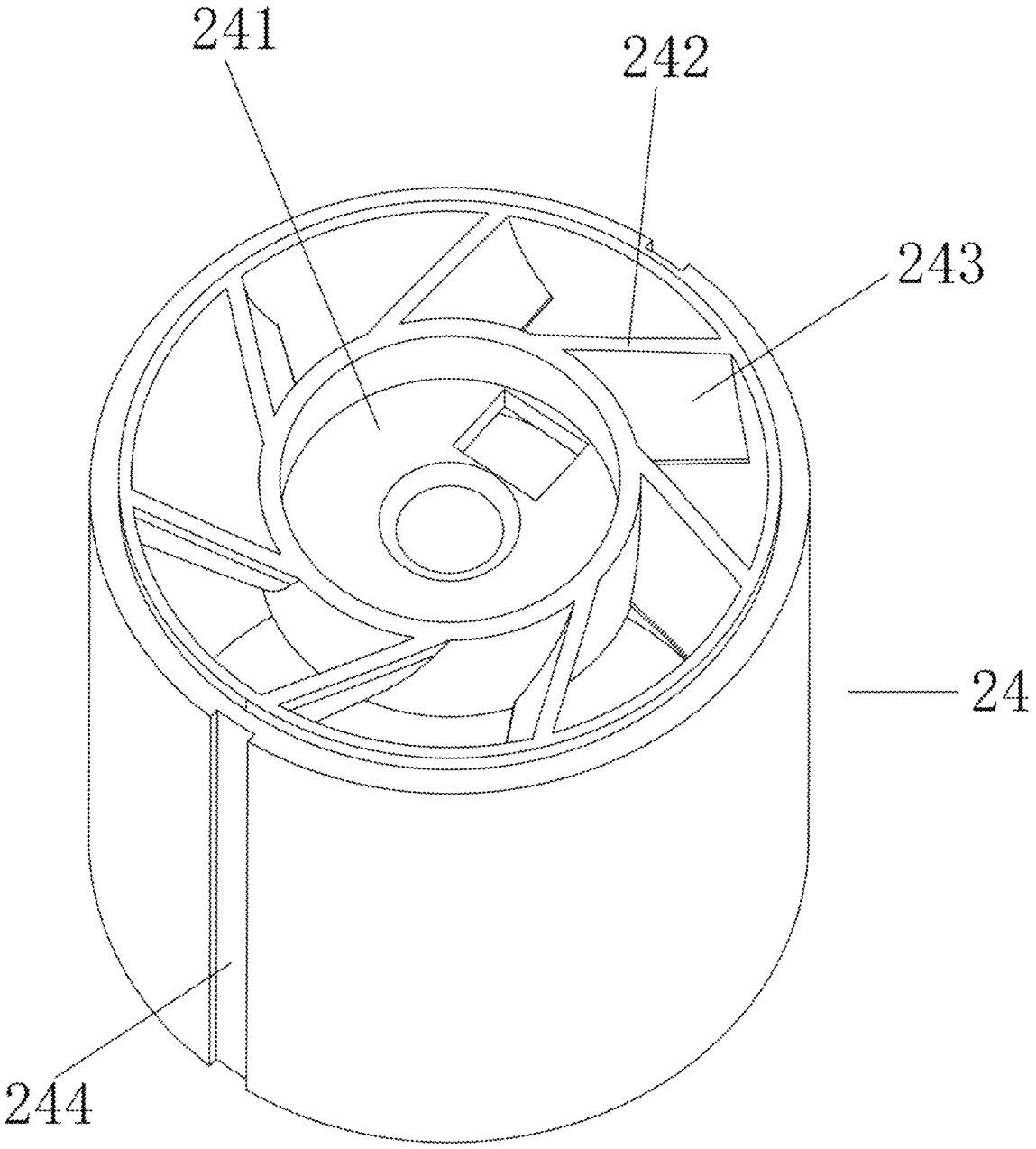
FIG. 5 is a schematic structural diagram of an air guide member of the present disclosure.
Figure 6:
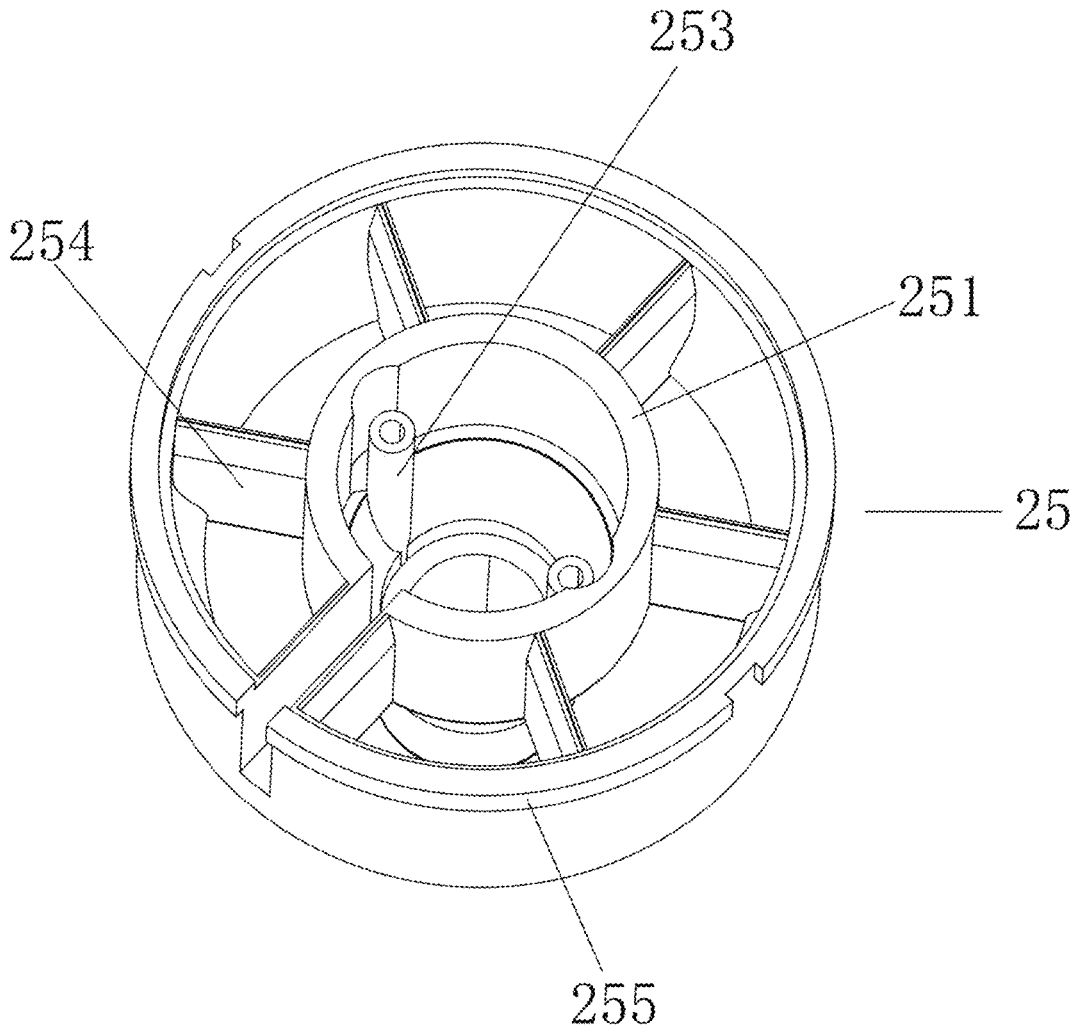
FIG. 6 is a schematic structural diagram of an outlet housing of the present disclosure.
Figure 7:
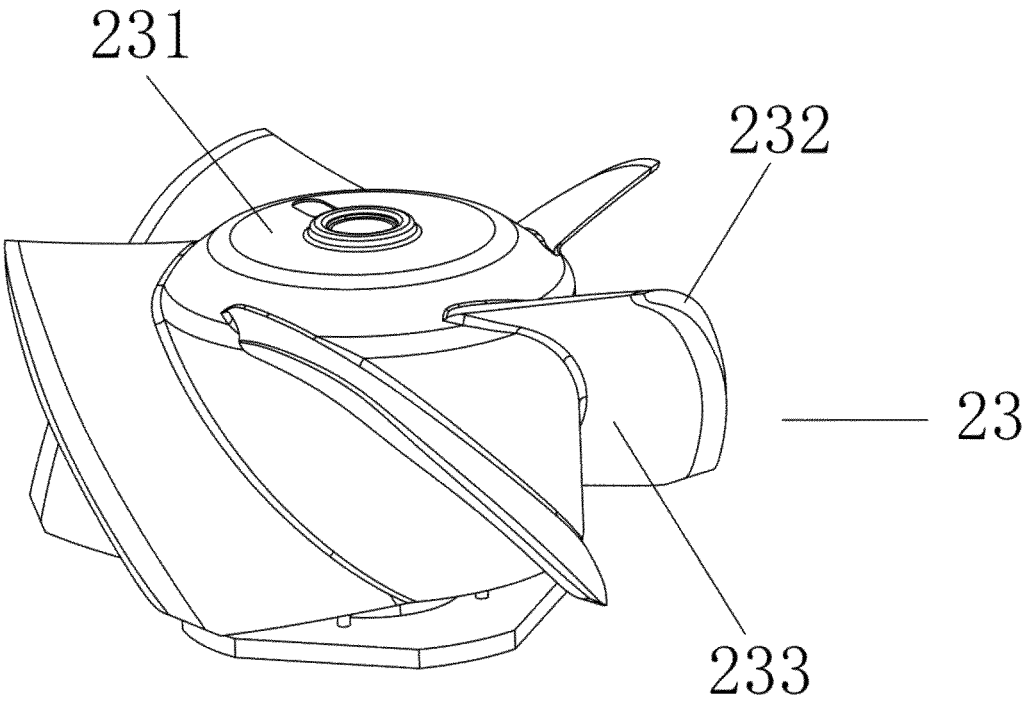
FIG. 7 is a schematic structural diagram of an air-driving fan blade group of the present disclosure.

Referring to FIG. 1 to FIG. 7, a high-speed neck fan includes a hanging piece 1 and a fan body 2 connected to an end portion of the hanging piece 1. The hanging piece 1 is a deformable snake-shaped pipe. The fan body 2 includes a shell 22; an air duct 221 and a coordination base 222 are formed on the shell 22; the coordination base 222 is connected to one side of a periphery of the air duct 221; the air duct and the coordination base are in a stacked state on a radial cross section of the air duct; one end of the air duct 221 is an air inlet 223, and the other end is an air outlet 224; an air-driving fan blade group 23 is arranged in the air duct 221; and the air-driving fan blade group 23 guides an air flow located at the air inlet 223 to pass through the air duct 221 and then be blown out from the air outlet 224 in an accelerated manner.

A motor base 241 is coaxially arranged in the air duct 221; an air guide member 24 is sleeved in the air duct 221; the air guide member 24 is a tubular body; the motor base 241 is arranged in the air guide member 24; a portion of a circumferential wall surface of the motor base 241 extends towards an inner wall of the air guide member 24 to form booster blades 242; the booster blades 242 are arranged on one side of the air-driving fan blade group 23 facing the air outlet 224; the air-driving fan blade group 23 includes a rotating seat 231 and air-driving blades 232 uniformly arranged on a peripheral wall surface of the rotating seat 231; rectifier blades 254 are arranged on sides of the booster blades 242 away from the air-driving fan blade group 23; the booster blades 242 achieves air-cutting boosting on an air flow conveyed by the air-driving blades 232; and the rectifier blades 254 guide the boosted air flow output from the booster blades 242, so that the boosted air flow is blown outwards in a direction parallel to an axial direction of the air outlet 224. The rectifier blades 254 arrange the high-pressure air flow, which can effectively reduce the turbulence in the air flow, thereby achieving the silencing and denoising effect. Meanwhile, the turbulence is reduced, and the utilization rate of the air flow can be increased. A surface of each of the booster blades 242 facing an outer side of the air outlet 224 is a windward surface 243, and a surface of one side of each of the air-driving blades 232 facing the booster blade 242 is an air-driving surface 233; in a rotation process of the air-driving fan blade group 23, the air-driving surfaces 233 rotate towards the windward surfaces 243; in the same radial area, a curved surface where the windward surface 243 is located is intersected with a curved surface where the air-driving surface 233 is located; and an angle between the windward surface 243 and the air-driving surface 233 is $\theta 1<90°$. An angle $\theta 2$ between the windward surface 243 and a central axis of the air-driving fan blade group 23 satisfies: $30°<\theta 2<60°$. When the angle between the windward surface 243 and the central axis of the air-driving fan blade group 23 is $\theta 2=45°$, the air flow blown from the booster blades 242 towards the rectifier blades 254 tends to be parallel to an axial direction of the air outlet 224, so that the utilization rate of the air flow is the largest.

An outlet housing 25 is covered at the air outlet 224; a connecting base 251 is coaxially arranged at a central axis of the outlet housing 25; the rectifier blades 254 are formed by radial extension of a portion of a circumferential wall surface of the connecting base 251; the rectifier blades 254 are arranged in a manner of being parallel to a central axis of the air outlet 224; a limiting step 225 is arranged at the air outlet 224 on an inner wall surface of the air duct 221; a limiting flange 255 corresponding to the limiting step 225 is arranged on an outer wall of the outlet housing 25; the outlet housing 25 is integrally connected to the air duct 221 through opposite limitation by the limiting step 225 and the limiting flange 255. A linear slot 244 is provided on an outer wall surface of the air guide member 24; the linear slot 244 extends in an axial direction of the air guide member 24; a linear column 226 corresponding to the linear slot 244 is arranged on an inner wall surface of the air duct 221; and the air guide member 24 cooperates with the linear column 226 through the linear slot 244 to achieve directed sliding. An inlet housing 21 is covered at the air inlet 223. During assembling, the outlet housing 25 is inserted into one end of the air duct 221 that is not provided with the limiting step 225; the air guide member 24 is then inserted into the air duct 221 immediately after the outlet housing 25 is inserted; the inlet housing 21 is covered at the air inlet 223, so that the inlet housing 21 and the air duct 221 are in buckling connection, and the outlet housing 25, the air guide member 24, the air duct 221, and the inlet housing 21 are integrally fixedly connected with each other; and the assembling operation is simple and fast.

An end portion of the hanging piece 1 is fixedly connected to the fan body 2 through a connecting mechanism. The connecting mechanism includes a hole groove 252 provided on the fan body 2, a plug 13 plugged into the hole groove 252, a ring slot 11 arranged at an end portion of the hanging piece 1, and a clamping ring 12 clamped with the ring slot 11. The hole groove 252 is arranged at an axis of the outlet housing 25. The hole groove 252 penetrates through the front and rear parts of the outlet housing 25. A hole diameter of one side of the hole groove 252 located at the outlet housing 25 and facing the air duct 221 is greater than a hole diameter of one side away from the air duct 221, so that the plug 13 will not exit from the end with the smaller hole diameter after being inserted into the end with the larger hole diameter. The plug 13 is provided with an axial through hole; and the end portion of the hanging piece 1 passes through the hole groove 252 and the through hole of the plug 13 in sequence, and is in buckling connection to the clamping ring 12. An outer diameter of the clamping ring 12 is greater than a hole diameter of the axial through hole of the plug 13. Therefore, the clamping ring 12 can achieve an effect of preventing the hanging piece 1 from being separated from the plug 13. A stud 253 is arranged in the hole groove 252; the stud 253 is parallel to a central axis of the hole groove 252; the plug 13 is provided with a stud sleeve 131 corresponding to the stud 253; and the stud sleeve 131 sleeves the stud 253 in a circumferential direction. The stud sleeve 131 can be prevented from exiting the stud 253 after a screw is locked on the stud 253, thereby achieving fixed connection between the plug 13 and the hole groove 252.

Each of two end portions of the hanging piece 1 is respectively connected with the fan body 2; a circuit board assembly 26 is arranged in the coordination base 222 of one fan body 2; the air-driving fan blade group 23 in the air duct 221 of the fan body is electrically connected to the circuit board assembly 26; a storage battery 27 is arranged in the coordination base 222 of the other fan body 2; and the storage battery 27 and the air-driving fan blade group 23 in the same fan body 2 as the storage battery are electrically connected to the circuit board assembly 26 through an internal routing of the hanging piece 1. The circuit board assembly 26 is electrically connected with a control button 261, a USB interface 262, and a light-emitting bead 263; the control button 261, the USB interface 262, and the light-emitting bead 263 are all arranged in preset through holes of the shell of the coordination base 222. The control button 261 is configured to control working states of the air-driving fan blade group 23 and the light-emitting bead 263; when the USB interface 262 is connected to an external power supply using a charging cable, the storage battery 27 can be charged to supplement electric energy; and the light-emitting bead 263 is configured for lighting at night. A thermal insulation pad 28 is sandwiched between the storage battery 27 and a wall surface of one side of the coordination base 222 away from the air duct 221. The storage battery 27 will generate heat during working. The thermal insulation pad 28 can prevent the heat from being transferred to a user and causing poor user experience.

In summary: According to the present disclosure, the coordination base 222 is formed on a side surface of the air duct 221. The coordination base 222 deviates from the axis of the air duct. When the fan is worn at the neck of a user, the coordination base 222 is sandwiched between the user and the air duct 221, and can support the fan bodies 2, so that the air outlets 224 of the fan can be appropriately far away from a blocked area of the user and can also blow air towards the head of the user. This not only ensures a smoother air outlet path and a better air blowing and cooling effect, but also improves the stability of wearing of the fan by forming friction between an outer wall of the coordination base 222 and the user. In addition, the downward pulling force of the fan bodies 2 can be increased by performing weight balancing on electric devices inside the coordination base 222, which further improves the stability of wearing of the fan. By the arrangement of a booster and rectifier mechanism on the air duct 221, the air speed and the air supply distance are greatly increased, and a silencing and denoising effect is achieved too. The user experience is effectively enhanced.

It should be noted that in this document, relationship terms such as first and second are used solely to distinguish one entity or operation from another entity or operation without necessarily requiring or implying any actual such relationship or order between such entities or operations. Furthermore, the terms "include", "including", or any other variation thereof, are intended to encompass a non-exclusive inclusion, such that a process, method, article, or device that includes a list of elements does not include only those elements but may include other elements not explicitly listed or inherent to such process, method, article, or device.

Although the embodiments of the present disclosure have been shown and described, it can be understood by those of ordinary skill in the art that various changes, modifications, substitutions, and variations can be made to these embodiments without departing from the principle and spirit of the present disclosure. The scope of the present disclosure is defined by the accompanying claims and their equivalents.

What is claimed is:

1. A high-speed neck fan, comprising a hanging piece (1) and a fan body (2) connected to an end portion of the hanging piece (1), wherein the fan body (2) comprises a shell (22); an air duct (221) and a coordination base (222) are formed on the shell (22); the coordination base (222) is connected to one side of a periphery of the air duct (221); the air duct and the coordination base are in a stacked state on a radial cross section of the air duct; one end of the air duct (221) is an air inlet (223), and the other end is an air outlet (224); an air-driving fan blade group (23) is arranged in the air duct (221); and the air-driving fan blade group (23) guides an air flow located at the air inlet (223) to pass through the air duct (221) and then be blown out from the air outlet (224) in an accelerated manner;

wherein a motor base (241) is coaxially arranged in the air duct (221); a portion of a circumferential wall surface of the motor base (241) extends towards an inner wall of the air duct (221) to form booster blades (242); the booster blades (242) are arranged on one side of the air-driving fan blade group (23) facing the air outlet (224); the air-driving fan blade group (23) comprises a rotating seat (231) and air-driving blades (232) uniformly arranged on a peripheral wall surface of the rotating seat (231); rectifier blades (254) are arranged on sides of the booster blades (242) away from the air-driving fan blade group (23); the booster blades (242) achieves air-cutting boosting on an air flow conveyed by the air-driving blades (232); and the rectifier blades (254) guide the boosted air flow output from the booster blades (242), so that the boosted air flow is blown outwards in a direction parallel to an axial direction of the air outlet (224);

wherein a surface of each of the booster blades (242) facing an outer side of the air outlet (224) is a windward surface (243), and a surface of one side of each of the air-driving blades (232) facing the booster blade (242) is an air-driving surface (233); in a rotation process of the air-driving fan blade group (23), the air-driving surfaces (233) rotate towards the windward surfaces (243); in the same radial area, a curved surface where the windward surface (243) is located is intersected with a curved surface where the air-driving surface (233) is located; and an angle between the windward surface (243) and the air-driving surface (233) is $\theta 1<90°$.

2. The high-speed neck fan according to claim 1, wherein an angle $\theta 2$ between the windward surface (243) and a central axis of the air-driving fan blade group (4) satisfies: $30°<\theta 2<60°$.

3. The high-speed neck fan according to claim 2, wherein the angle between the windward surface (243) and the central axis of the air-driving fan blade group (4) is $\theta 2=45°$.

4. The high-speed neck fan according to claim 1, wherein an air guide member (24) is sleeved in the air duct (221); the air guide member (24) is a tubular body; the motor base (241) is arranged in the air guide member (24); the booster blades (242) are formed by extension of the portion of the circumferential wall surface of the motor base (241) towards an inner wall of the air guide member (24); a linear slot (244) is provided on an outer wall surface of the air guide member (24); the linear slot (244) extends in an axial direction of the air guide member (24); a linear column (226) corresponding to the linear slot (244) is arranged on an inner wall surface of the air duct (221); and the air guide member (24) cooperates with the linear column (226) through the linear slot (244) to achieve directed sliding.

5. The high-speed neck fan according to claim 1, wherein an outlet housing (25) is covered at the air outlet (224); a connecting base (251) is coaxially arranged at a central axis of the outlet housing (25); the rectifier blades (254) are formed by radial extension of a portion of a circumferential wall surface of the connecting base (251); the rectifier blades (254) are arranged in a manner of being parallel to a central axis of the air outlet (224); a limiting step (225) is arranged at the air outlet (224) on an inner wall surface of the air duct (221); a limiting flange (255) corresponding to the limiting step (225) is arranged on an outer wall of the outlet housing (25); the outlet housing (25) is integrally connected to the air duct (221) through opposite limitation by the limiting step (225) and the limiting flange (255).

6. The high-speed neck fan according to claim 1, wherein an end portion of the hanging piece (1) is fixedly connected to the fan body (2) through a connecting mechanism; the connecting mechanism comprises a hole groove (252) provided on the fan body (2), a plug (13) plugged into the hole groove (252), a ring slot (11) arranged at an end portion of the hanging piece (1), and a clamping ring (12) clamped with the ring slot (11); the hole groove (252) penetrates through the shell of the fan body (2); the plug (13) is provided with an axial through hole; the end portion of the hanging piece (1) passes through the hole groove (252) and the through hole of the plug (13) in sequence, and is in buckling connection to the clamping ring (12); a stud (253) is arranged in the hole groove (252); the stud (253) is parallel to a central axis of the hole groove (252); the plug (13) is provided with a stud sleeve (131) corresponding to the stud (253); and the stud sleeve (131) sleeves the stud (253) in a circumferential direction.

7. The high-speed neck fan according to claim 1, wherein an inlet housing (21) is covered at the air inlet (223).

8. The high-speed neck fan according to claim 1, wherein each of two end portions of the hanging piece (1) is respectively connected with the fan body (2); a circuit board assembly (26) is arranged in the coordination base (222) of one fan body (2); the air-driving fan blade group (23) in the air duct (221) of the fan body is electrically connected to the circuit board assembly (26); a storage battery (27) is arranged in the coordination base (222) of the other fan body (2); and the storage battery (27) and the air-driving fan blade group (23) in the same fan body (2) as the storage battery are electrically connected to the circuit board assembly (26) through an internal routing of the hanging piece (1).

9. The high-speed neck fan according to claim 8, wherein the circuit board assembly (26) is electrically connected with a control button (261), a USB interface (262), and a light-emitting bead (263); the control button (261), the USB interface (262), and the light-emitting bead (263) are all arranged in preset through holes of the shell of the coordination base (222); and a thermal insulation pad (28) is sandwiched between the storage battery (27) and a wall surface of one side of the coordination base (222) away from the air duct (221).

10. The high-speed neck fan according to claim 1, wherein the hanging piece (1) is a deformable snake-shaped pipe.

* * * * *